US006178648B1

(12) United States Patent
Ledys et al.

(10) Patent No.: US 6,178,648 B1
(45) Date of Patent: Jan. 30, 2001

(54) FASTENING DEVICE FOR A MUZZLE MIRROR

(75) Inventors: Francis Ledys, Saint Florent; Régis Dupuy, La Chapelle Saint Ursin, both of (FR)

(73) Assignee: Giat Industries (FR)

( * ) Notice: Under 35 U.S.C. 154(b), the term of this patent shall be extended for 0 days.

(21) Appl. No.: 09/307,762

(22) Filed: May 10, 1999

(30) Foreign Application Priority Data

May 18, 1998 (FR) ..... 98 06350

(51) Int. Cl.[7] ..... F41G 3/02
(52) U.S. Cl. ..... 33/233; 42/76.01; 33/250
(58) Field of Search ..... 42/76.01; 33/247, 33/233, 250

(56) References Cited

U.S. PATENT DOCUMENTS

| | | | | |
|---|---|---|---|---|
| 1,227,544 | * | 5/1917 | Lobdell | 33/233 |
| 1,264,133 | * | 4/1918 | Morris | 33/233 |
| 1,428,115 | * | 9/1922 | Perrin | 33/247 |
| 1,501,211 | * | 7/1924 | Forin | 33/233 |
| 1,668,975 | * | 5/1928 | Paulus et al. | 33/233 |
| 2,123,273 | * | 7/1938 | Burton | 33/233 |
| 2,607,993 | * | 8/1952 | McKay | 33/233 |
| 3,260,008 | * | 7/1966 | Yeomans, Jr. | 33/233 |
| 3,646,682 | * | 3/1972 | Edwin | 33/233 |
| 3,863,354 | * | 2/1975 | Karppinen | 33/233 |
| 3,945,142 | * | 3/1976 | Keppeler | 33/233 |
| 4,242,825 | * | 1/1981 | deBoer | 42/76.01 |
| 4,776,126 | * | 10/1988 | Williams | 42/101 |
| 5,442,860 | * | 8/1995 | Palmer | 33/233 |
| 5,877,902 | * | 3/1999 | Sauter | 33/233 |
| 6,085,427 | * | 7/2000 | Persson | 33/233 |

FOREIGN PATENT DOCUMENTS

| | | |
|---|---|---|
| 2950173 | 6/1981 | (DE) . |
| 2504668 | 10/1982 | (FR) . |

* cited by examiner

*Primary Examiner*—Charles T. Jordan
*Assistant Examiner*—Denise J Buckley

(57) ABSTRACT

The subject of the invention is a fastening device for a muzzle mirror at one end of an artillery gun barrel, device comprising a mirror support incorporating at least two flanges encircling the gun barrel and connected to one another by a first linking means. In this device the flanges are housed in a groove made in the barrel and are linked in rotation to said barrel by means of an obstacle, such as a pin, such device also comprising a centering collar constituted by at least two jaws connected by a second linking means, such collar having a tapered support co-operating with a matching tapered support arranged on the flanges such that tightening the second linking means ensures both the axial and radial retention of the flanges.

4 Claims, 3 Drawing Sheets

FASTENING DEVICE FOR A MUZZLE MIRROR

BACKGROUND OF THE INVENTION

The technical scope of the invention is that of devices allowing a muzzle mirror to be fastened to one end of an artillery barrel.

The purpose of muzzle mirrors is to supply the artillery fire control with the true position of the end of the barrel.

Indeed, the thermal stresses resulting from the firing as well as the meteorological conditions cause a variable strain of the gun barrel (generally called bending).

However, the external ballistics (and therefore firing accuracy) is linked to the true position of the muzzle of the barrel. Firing accuracy will thus be strongly affected by the bending of the barrel and the fire control must possess the accurate co-ordinates of the barrel muzzle so as to control laying appropriately.

The muzzle mirror is a polished surface that receives a laser beam emitted by the fire control. This mirror reflects the beam, a sensor on the fire control picks up the reflected beam and thereby determines the true position of the barrel muzzle depending on the deviation measured.

Known fastening devices for muzzle mirrors generally incorporate fastening flanges that encircle the gun barrel. They present the drawback of badly withstanding the stresses due to firing (recoil accelerations and vibrations), such stresses being all the greater in that the barrel of the gun generally incorporates a muzzle brake that rejects part of the propellant gases to the rear, thus towards the mirror. The radial and/or axial position of the mirror is thus gradually modified and the firing reference measured becomes incorrect.

So as to overcome such drawbacks, the mirror is sometimes welded to the barrel. However, such an arrangement complicates the installation of thermal sleeves and smoke boxes onto the barrel. Indeed, these elements can no longer be designed in the shape of cylindrical barrels slipped over the barrel but must be constituted by two half-shells assembled using toggle fasteners.

Moreover, welding imposes the choice of a material for the mirror support analogous to that constituting the barrel thereby leading to the definition of a heavy mirror support increasing the bending of the barrel.

SUMMARY OF THE INVENTION

The aim of the invention is to propose a fastening device for a muzzle mirror that does not present such drawbacks.

The device according to the invention is of a simple and rugged structure and enables the reliable positioning of the muzzle mirror at the end of the gun barrel.

Thus, the subject of the invention is a fastening device for a muzzle mirror at one end of an artillery gun barrel, device comprising a mirror support incorporating at least two flanges encircling the gun barrel and connected to one another by a first linking means, wherein said flanges are housed in a groove made in the barrel and are linked in rotation to said barrel by means of an obstacle, such device also comprising a centering collar housed in the groove, such collar being constituted by at least two jaws connected by a second linking means, such collar having a tapered support co-operating with a matching tapered support arranged of the flanges such that tightening the second linking means ensures both the axial and radial retention of the flanges.

The centering collar will, advantageously, comprise three identical jaws connected in pairs using screws.

Each jaw can have transversal slits intended to make its strain easier.

The first and second linking means can incorporate screws as well as tapered washers placed under the screw heads, such washers allowing an elastic radial strain of the support and the collar.

BRIEF DESCRIPTION OF THE DRAWINGS

The invention will be better understood after reading the description that follows of a particular embodiment, such description being made with reference to the appended drawings in which.

DETAILED DESCRIPTION OF PREFERRED EMBODIMENTS

Figure 1:
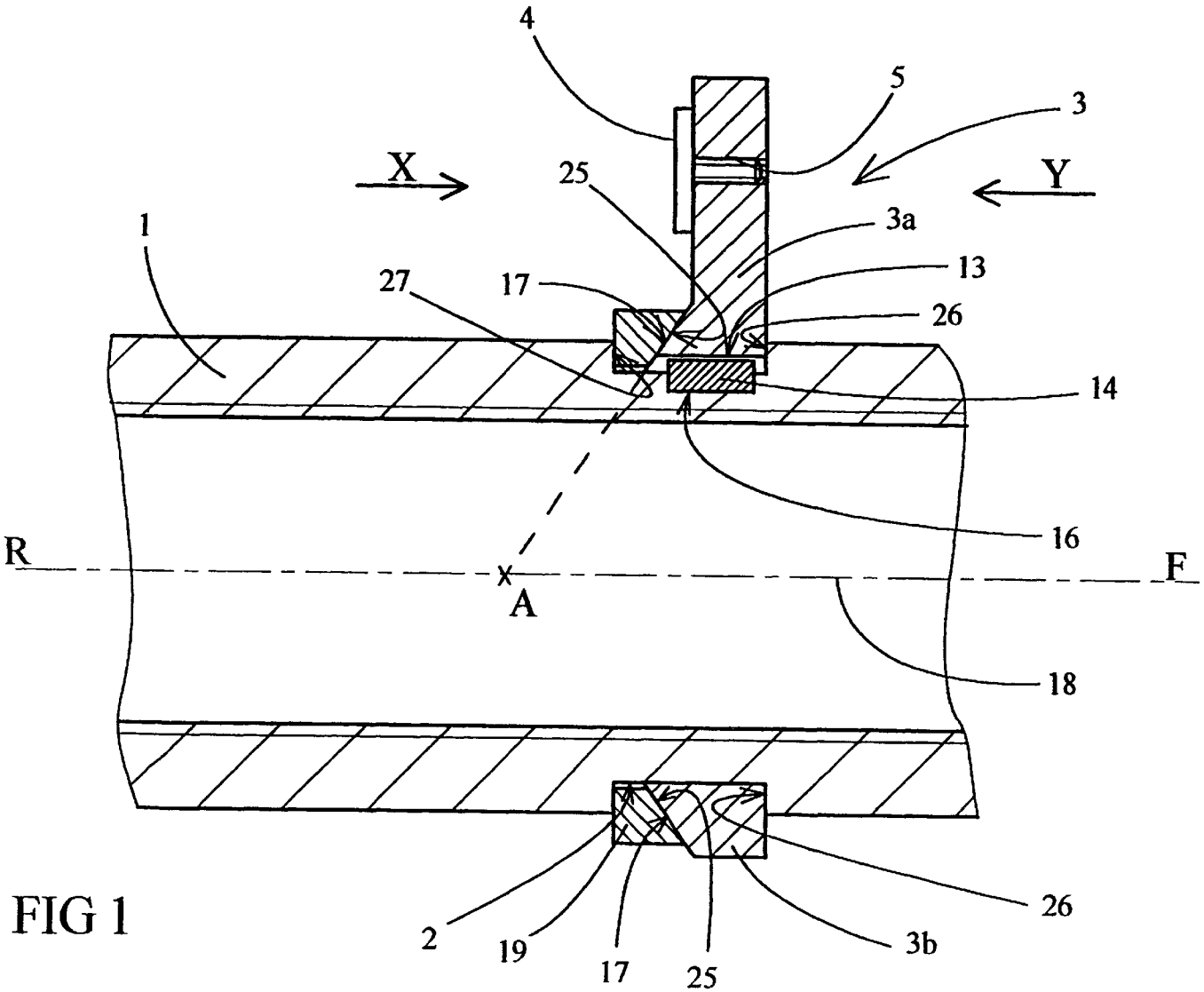
FIG. 1 represents a transversal section of a fastening device for a muzzle mirror arranged at one end of an artillery barrel.
Figure 2:
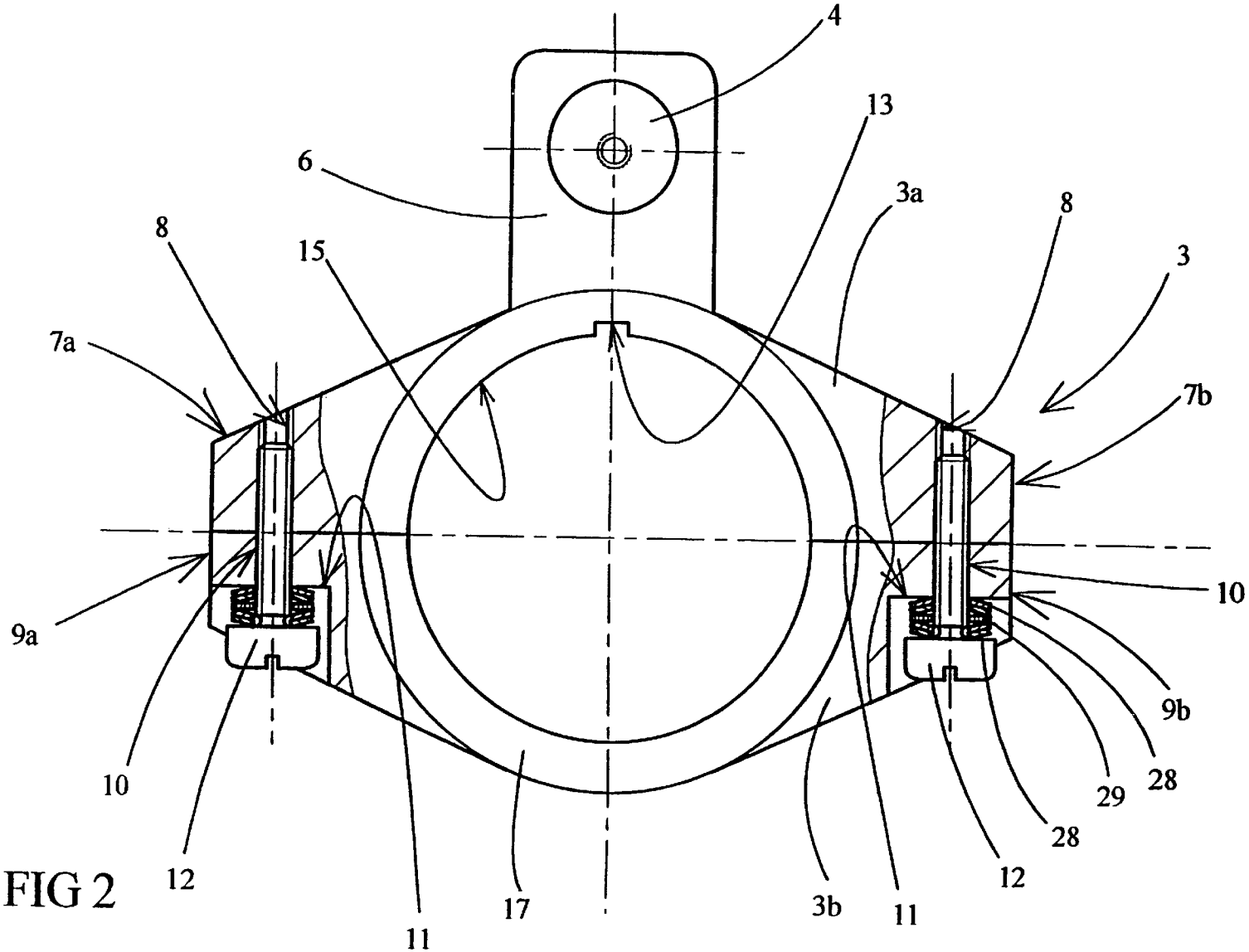
FIG. 2 is a view of the mirror flanges alone along the direction indicated by arrow X in FIG. 1.

With reference to FIG. 1, the end of a gun barrel 1 is partly shown as a longitudinal section. Barrel 1 has a ring-shaped groove 2 intended to receive a support 3 of a muzzle mirror 4.

Mirror 4 is formed by a disc of reflective metal that is fastened onto support 3 by a threaded rod 5.

Support 3 incorporates two flanges 3*a* and 3*b*. Upper flange 3*a* incorporates an extension 6 on which mirror 4 is fastened as well as side lugs 7*a*, 7*b* that each have a tapping 8.

Lower flange 3*b* incorporates side lugs 9*a*, 9*b* that each have a bore 10 and a countersinking 11. Screws 12 are introduced into bores 10 to ensure, by means of tapings 8, the consolidation of flanges 3*a* and 3*b*. Flexible tapered washers 28 are mounted under screw heads 12, in pairs face to face, separated by a flat washer 29. An appropriate tightening moment is given to each screw so as to leave a certain degree of strain for the tapered washers. This assembly is intended to flexibly link the two flanges so as to allow the slight swelling of the barrel that occurs when a projectile is fired. A rigid assembly, without washers enabling radial strain, would generate harmful stresses for the screws or the tapings when a projectile is fired. Screw 12 and washers 28, 29 form the first linking means for the two flanges 3*a*, 3*b*.

Upper flange 3*a* also incorporates a longitudinal groove 13 arranged on the inner cylindrical surface 15 of flange 3*a*. This groove is intended to receive a pin 14 that is also placed in a housing 16 made in the bottom of groove 2.

Pin 14 thus forms an obstacle that ensures the consolidation in rotation of support 3 and barrel 1. By way of a variant, it is possible for a ball-bearing to be used instead of the pin placed between the support and barrel and co-operating with appropriate indentations made in the support and the barrel.

Support 3 also has a convex tapered support 17 whose apex A is located virtually on axis 18 of gun barrel 1 and the narrow end of whose tapered part is directed towards front part F of the barrel.

Figure 3:
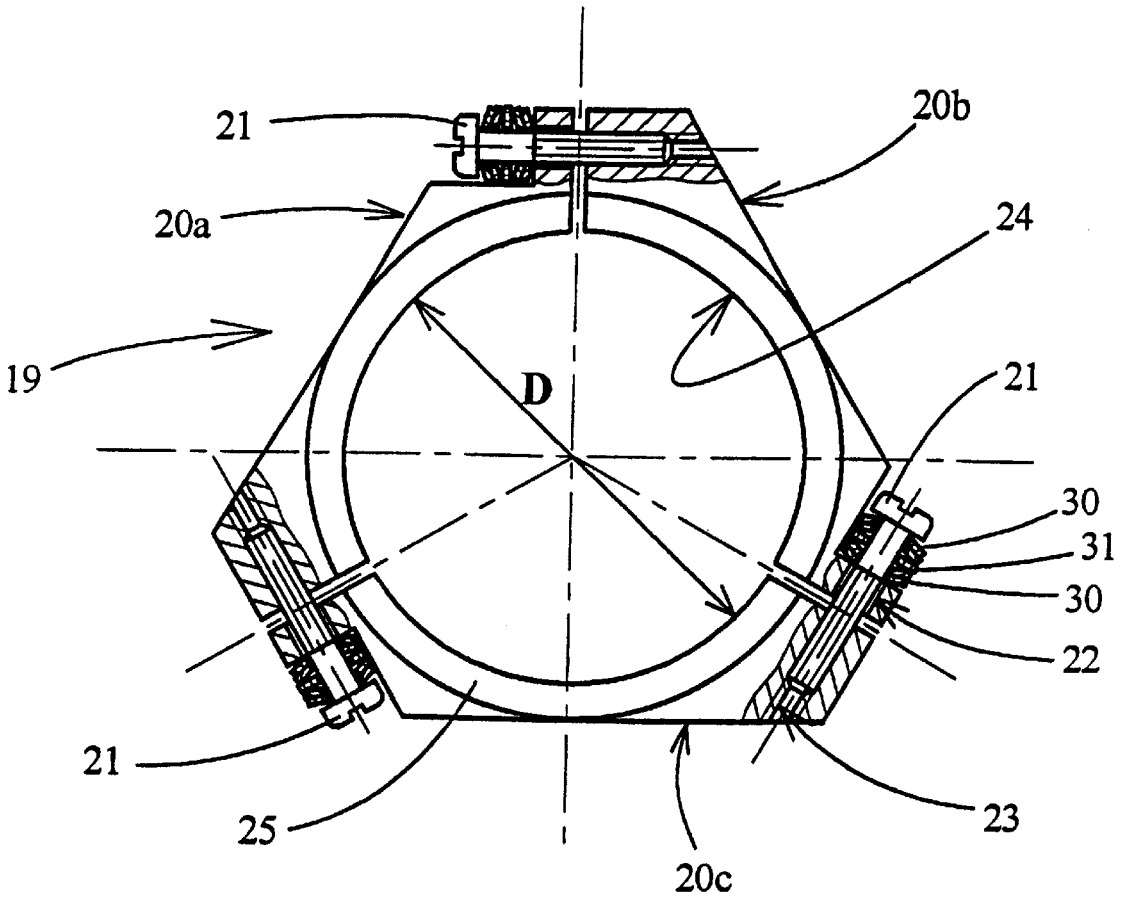
FIG. 3 is a view of the centring collar alone along the direction indicated by arrow Y in FIG. 1.

The fastening device according to the invention also incorporates a centering collar 19 that is, in this case, constituted by three jaws 20*a*, 20*b*, 20*c* (see FIG. 3) connected by a second linking means formed here by screws 21 and washers 30, 31. All the jaws are identical and substantially cover an angular sector of 120°. Each jaw incorporates a perforation 22 at one end intended to receive a screw head 21 and a tapping 23 at its other end to receive the threaded part of another screw 21. As in the assembly of the flanges previously described, tapered washers 30 and flat washer 31 are placed under screw heads 21.

Thus, each jaw is fastened to its two neighbours by a screw and tightening the three screws using an appropriate moment results in the gradual reduction of diameter D of inner bore 24 delimited by assembled collar 19. The washers 30 also allow the barrel to swell when a projectile is being fired.

Collar 19 has a tapered support 25 that is intended to co-operate with matching tapered support 17 carried by flanges 3*a*, 3*b*.

The device according to the invention is mounted as follows:

First of all, flanges 3*a* and 3*b* of the support are positioned in groove 2, the pin being set into place between its housing 16 and groove 13. The two flanges 3*a*, 3*b* are made integral by tightening screws 12.

Thereafter, jaws 20*a*, 20*b*, 20*c* with their tapered support 25 are positioned in contact with tapered support 17. Screws 21 allow the jaws to be retained in groove 2.

Screws 21 are tightened thereby making the jaws come closer together and thus reducing the inner diameter D of collar 19. The reduction in diameter (by the co-operation of tapered supports 25 and 17) causes support 3 to axially abut against the front rim 26 of groove 2 and provides the radial retention of said support.

The rear face of collar 19 is furthermore locked against rear rim 27 of groove 2. The mirror support is thereby perfectly wedged in place, such arrangement being able to withstand the stress and vibrations caused by firing the artillery. By way of a variant, it is naturally possible to vary the number of jaws of collar 19 as well as the number of support flanges 3. By splitting centering collar 19 into three jaws, the contact surfaces are able to be spread between tapered supports 25 and 17. A greater number of jaws improves the distribution of the stresses.

Figure 4:
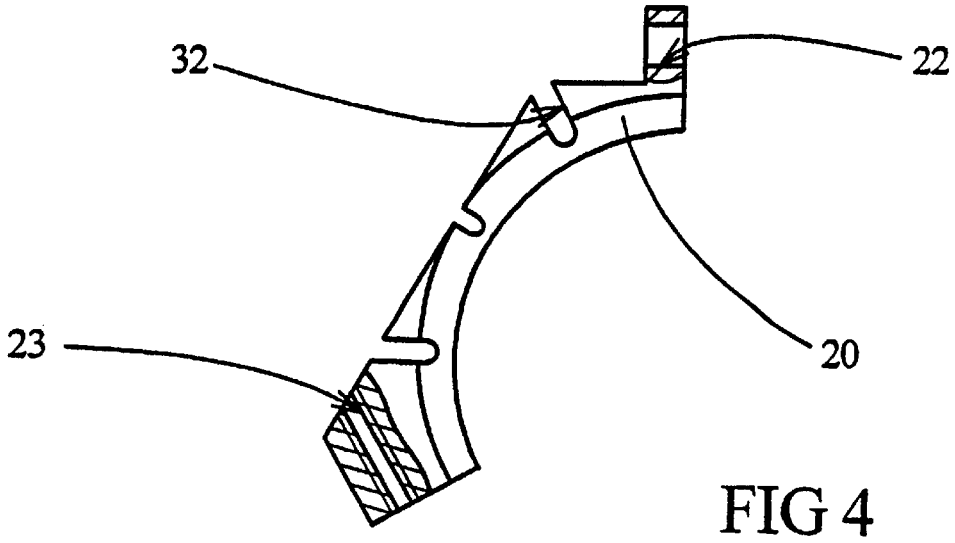
FIG. 4 is a variant embodiment of a jaw of the centring collar.

By way of a variant, transversal slits 32 can also be provided on each jaw 20 that make the elastic strain of the jaws easier during the tightening of screws 21 (see FIG. 4). The tightening effect is thereby improved.

We claim:

1. A fastening device for a muzzle mirror at one end of an artillery gun barrel, comprising a mirror support incorporating at least two flanges encircling said gun barrel and connected to one another by a first linking means, wherein said flanges are housed in a groove made in said barrel and are linked in rotation to said barrel by means of an obstacle, said device also comprising a centering collar housed in said groove, said collar being constituted by at least two jaws connected by a second linking means, said collar having a tapered support co-operating with a matching tapered support arranged on said flanges such that tightening said second linking means ensures both the axial and radial retention of said flanges.

2. A fastening device according to claim 1, wherein said centering collar comprises three identical jaws connected in pairs using screws.

3. A fastening device according to claim 1, wherein each jaw has transversal slits intended to make its strain easier.

4. A fastening device according to claim 1, wherein said first and second linking means incorporate screws as well as tapered washers located under the heads of said screw, said washers allowing an elastic radial strain of said support and said collar.

* * * * *